US008284139B2

(12) United States Patent
Lee et al.

(10) Patent No.: US 8,284,139 B2
(45) Date of Patent: Oct. 9, 2012

(54) GAMMA VOLTAGE GENERATING APPARATUS FOR GENERATING INTERPOLATED GAMMA VOLTAGE AND GAMMA VOLTAGE GENERATOR THEREOF

(75) Inventors: Tzung-Yuan Lee, Taichung County (TW); Chung-Jian Li, Hsinchu County (TW); Shang-I Liu, Hsinchu (TW); Hao-Jan Huang, Hsinchu (TW); Shir-Kuan Lin, Hsinchu (TW); Wing-Kai Tang, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 570 days.

(21) Appl. No.: 12/469,660

(22) Filed: May 20, 2009

(65) Prior Publication Data

US 2010/0207963 A1 Aug. 19, 2010

(30) Foreign Application Priority Data

Feb. 19, 2009 (TW) ..... 98105256 A

(51) Int. Cl.
*G09G 3/36* (2006.01)

(52) U.S. Cl. ..... 345/89; 345/690

(58) Field of Classification Search ..... 345/89, 345/98, 211

See application file for complete search history.

(56) References Cited

U.S. PATENT DOCUMENTS

| | | | | |
|---|---|---|---|---|
| 5,517,212 | A * | 5/1996 | Inoue | 345/211 |
| 5,625,387 | A * | 4/1997 | Moon | 345/211 |
| 5,648,791 | A * | 7/1997 | Date et al. | 345/89 |
| 5,774,106 | A * | 6/1998 | Nitta et al. | 345/98 |
| 6,266,040 | B1 * | 7/2001 | Nagatomo | 345/98 |
| 7,999,780 | B2 * | 8/2011 | Hashimoto et al. | 345/98 |
| 2004/0056832 | A1 * | 3/2004 | Abe | 345/90 |
| 2008/0291190 | A1 * | 11/2008 | Kim et al. | 345/211 |

* cited by examiner

*Primary Examiner* — Chanh Nguyen
*Assistant Examiner* — Kwang-Su Yang
(74) *Attorney, Agent, or Firm* — Jianq Chyun IP Office

(57) ABSTRACT

A gamma voltage generator including an operation amplifier, a first reference impedance unit, a second reference impedance unit, a first variable impedance unit, a second variable impedance unit, and a select unit is provided. The operation amplifier generates an amplified output voltage. The first reference impedance unit receives a first gamma voltage, and the second reference impedance unit receives a second gamma voltage. The first variable impedance unit provides a first variable impedance, and the second variable impedance unit receives the first gamma voltage and provides a second variable impedance. The select unit selects the amplified output voltage or the first gamma voltage according to a control signal to generate an interpolated gamma output voltage.

24 Claims, 6 Drawing Sheets

GAMMA VOLTAGE GENERATING APPARATUS FOR GENERATING INTERPOLATED GAMMA VOLTAGE AND GAMMA VOLTAGE GENERATOR THEREOF

CROSS-REFERENCE TO RELATED APPLICATION

This application claims the priority benefit of Taiwan application serial no. 98105256, filed on Feb. 19, 2009. The entirety of the above-mentioned patent application is hereby incorporated by reference herein and made a part of specification.

BACKGROUND OF THE INVENTION

1. Field of the Invention

The present invention relates to a gamma voltage generator.

2. Description of Related Art

Along with the development of electronic technologies, products related to digital display and image processing techniques have been widely used. Besides, because a digital signal processor (DSP) offers a high calculation speed, the enhancement of image brightness is usually performed in a display panel (for example, a liquid crystal display (LCD) panel) by multiplying an input pixel data by a specific floating-point multiple to generate a corresponding output pixel data. FIG. 1 illustrates the relationship between an input pixel data Di_i and an output pixel data Di_o with two curves. The curve 110 indicates a linear relationship between the input pixel data $D_{i_i}$ and the output pixel data $D_{i_o}$, and the curve 120 indicates a non-linear relationship between the input pixel data $D_{i_i}$ and the output pixel data.

However, regardless of whether the relationship between the input pixel data $D_{i_i}$ and the output pixel data $D_{i_o}$ is linear or non-linear, the pixel data is always converted into an analog voltage by the gamma voltage generating apparatus 200 as shown in FIG. 2, wherein the digital output pixel data $D_{i_o1}$~$D_{i_o3}$ is received by the digital-to-analog converters (DACs) 211~213 and converted by the same into analog gamma voltages $V_{m-1}$~$V_{P+1}$.

In other words, the conventional gamma voltage generating apparatus 200 can only generate a gamma voltage corresponding to a digital output pixel data, and the digital output pixel data can only be an integer within a specific range due to the limitation of the bit number of the digital system. For example, if the output pixel data has 8 bits, the output pixel data can only be an integer between 0 and 255.

In addition, the following situation will be produced if an image is processed regarding some specific characteristic thereof (for example, the brightness or contrast of the image is changed). Referring to FIG. 1 again, the slope of the curve 110 around the origin is 1.1479 (which is the slope of a two-phase linear conversion curve most commonly seen in the industry). If the input image data is grayscale 30, the output image data obtained through floating-point calculation is grayscale 34.437 (=30×1.1479). If the input image data is grayscale 31, the output image data obtained through floating-point calculation is grayscale 35.5849 (=31×1.1479). However, a display circuit and its DAC usually do not accept such grayscale data as 34.437 and 35.5849. Thus, data like 34.437 is usually rounded down to grayscale 34 and data like 35.5849 is usually rounded up to grayscale 36 through a digital method.

It can be well understood from the example described above that such a conversion and rounding action may cause the grayscale 35 to disappear. This is due to the limitation in the structures of the existing circuit and DAC. As a result, image and color distortion may be caused.

SUMMARY OF THE INVENTION

Accordingly, the present invention is directed to a gamma voltage generator which adjust and generate an interpolated gamma output voltage dynamically corresponding to a floating-point grayscale data.

The present invention is further directed to a gamma voltage generating apparatus which divides an interpolated gamma output voltage to generate a plurality of divided interpolated gamma output voltages.

The present invention provides a gamma voltage generator including an operation amplifier, a first reference impedance unit, a second reference impedance unit, a first variable impedance unit, a second variable impedance unit, and a select unit. The operation amplifier has a first input terminal, a second input terminal, and an amplified output terminal, wherein the amplified output terminal generates an amplified output voltage. The first reference impedance unit has one terminal for receiving a first gamma voltage and another terminal coupled to the first input terminal of the operation amplifier. The second reference impedance unit has one terminal for receiving a second gamma voltage and another terminal coupled to the second input terminal of the operation amplifier. The first variable impedance unit is coupled between the first input terminal and the amplified output terminal of the operation amplifier and provides a first variable impedance. The second variable impedance unit is coupled between the second input terminal of the operation amplifier and one terminal of the first reference impedance unit and provides a second variable impedance. The select unit is coupled to the operation amplifier and selects the amplified output voltage or the first gamma voltage according to a control signal to generate an interpolated gamma output voltage.

The present invention further provides a gamma voltage generating apparatus including a plurality of gamma voltage generators and a plurality of voltage dividing elements. Each of the gamma voltage generators includes an operation amplifier, a first reference impedance unit, a second reference impedance unit, a first variable impedance unit, a second variable impedance unit, and a select unit. The operation amplifier has a first input terminal, a second input terminal, and an amplified output terminal, wherein the amplified output terminal generates an amplified output voltage. The first reference impedance unit has one terminal for receiving one of a plurality of gamma voltages and another terminal coupled to the first input terminal of the operation amplifier. The second reference impedance unit has one terminal for receiving another one of the gamma voltages and another terminal coupled to the second input terminal of the operation amplifier. The first variable impedance unit is coupled between the first input terminal and the amplified output terminal of the operation amplifier and provides a first variable impedance. The second variable impedance unit is coupled between the second input terminal of the operation amplifier and one terminal of the first reference impedance unit and provides a second variable impedance. The select unit is coupled to the operation amplifier and selects the amplified output voltage or the first gamma voltage according to a control signal to generate an interpolated gamma output voltage. In addition, the voltage dividing elements are sequentially connected in series between the terminals of the gamma voltage generators for generating the interpolated gamma output voltages and generate a plurality of divided interpolated gamma output voltages.

As described above, present invention provides the variable impedance unit, the reference impedance unit and the amplifier for generating an interpolated gamma output voltage by performing an interpolation calculation to two different gamma voltages. Thereby, interpolated gamma output voltages corresponding to floating-point grayscale data can be generated. Accordingly, the resolution of grayscale voltages supplied to a display is increased and image distortion is reduced.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
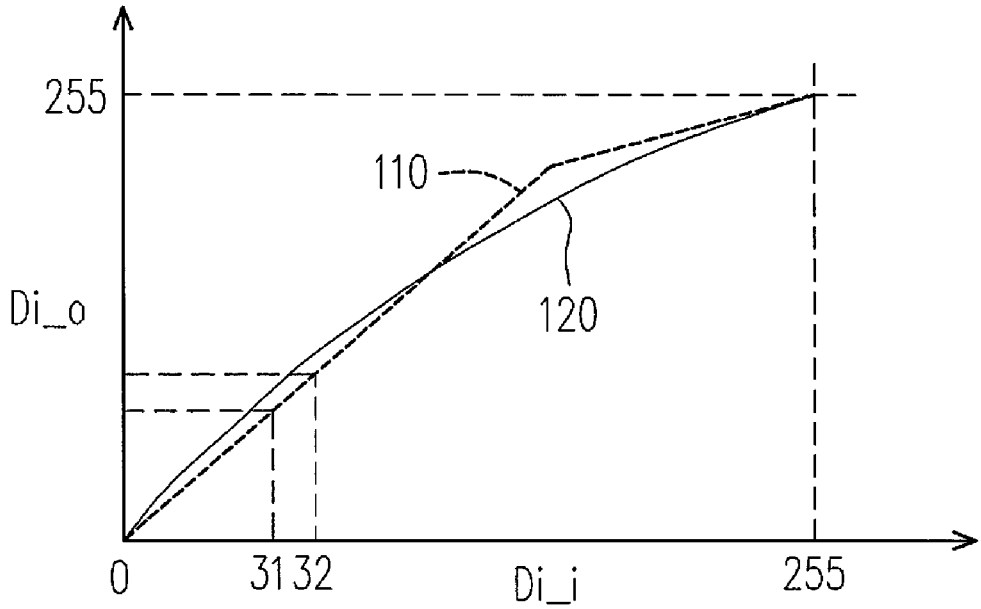
FIG. 1 (RELATED ART)
FIG. 1 illustrates the relationship between an input pixel data Di_i and an output pixel data Di_o with two curves.

Reference will now be made in detail to the present preferred embodiments of the invention, examples of which are illustrated in the accompanying drawings. Wherever possible, the same reference numbers are used in the drawings and the description to refer to the same or like parts.

Figure 2:
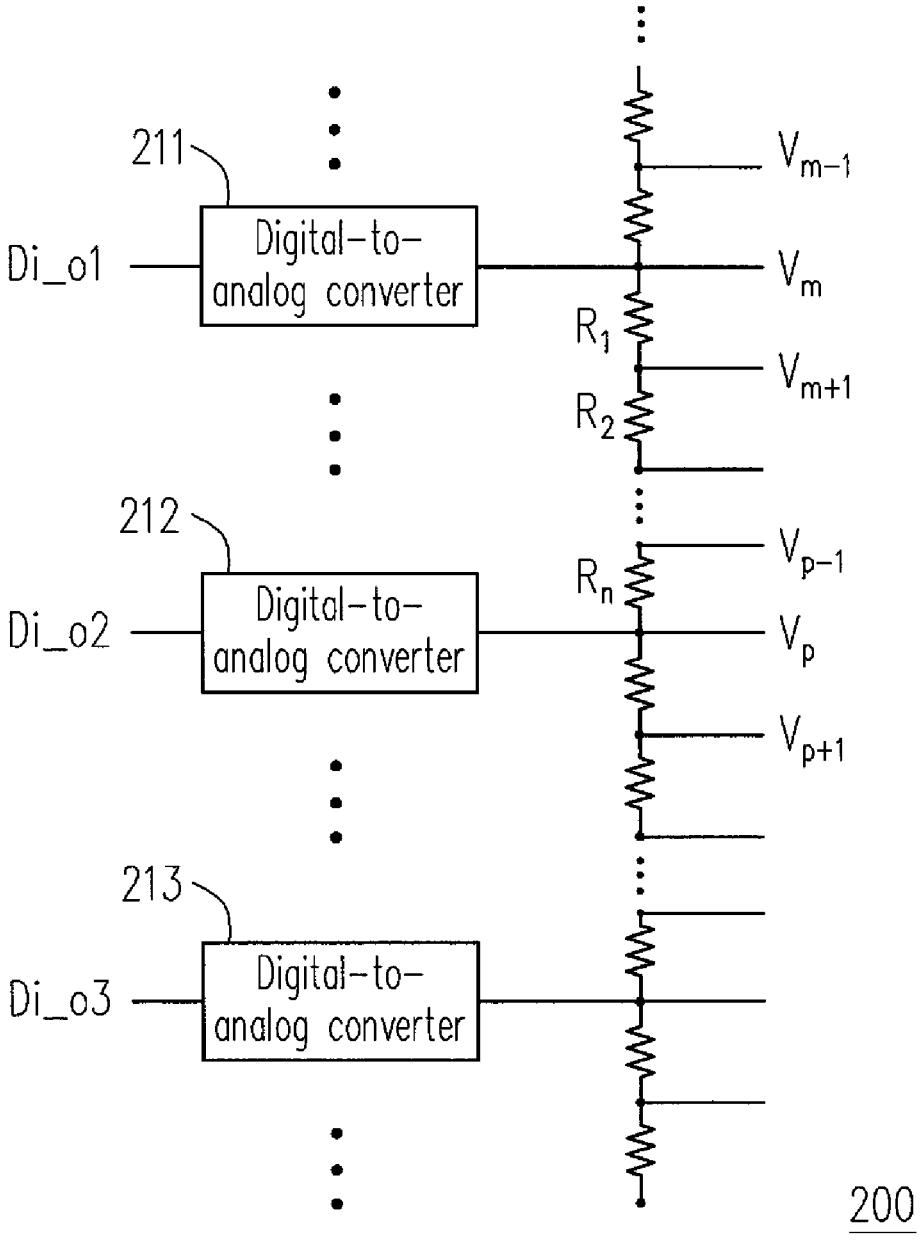
FIG. 2 (RELATED ART)
FIG. 2 is a diagram of a conventional gamma voltage generating apparatus 200.
Figure 3:
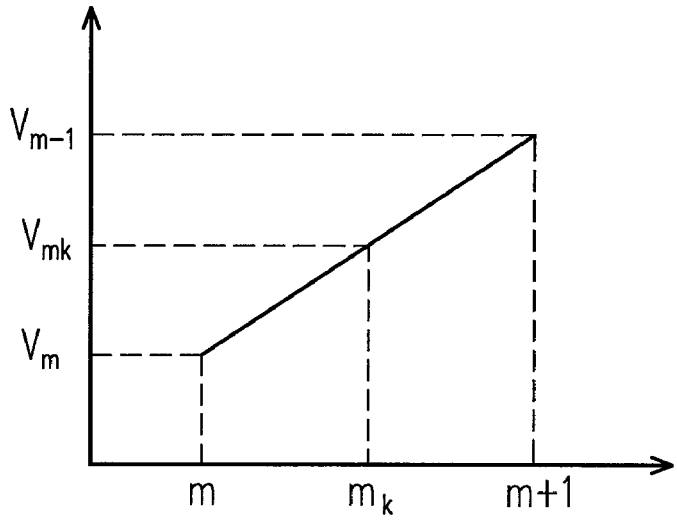
FIG. 3 is a diagram illustrating an interpolation calculation.

FIG. 3 is a diagram illustrating an interpolation calculation. Referring to both FIG. 2 and FIG. 3, it is assumed that the gamma voltage $V_{m+1}$ is corresponding to pixel data grayscale m+1, and the gamma voltage $V_m$ is corresponding to the pixel data grayscale m, and the gamma voltage almost presents a linear variation between the pixel data grayscales m and m+1. Based on foregoing assumptions, the gamma voltage $V_{mk}$ corresponding to a grayscale $m_k$ between the grayscales m and m+1 ($m_k$ is a floating-point number between m and m+1) can be calculated through interpolation as:

$$V_{mk}=(V_{m+1}-V_m)(m_k-m)+V_m \quad (1)$$

The gamma voltage $V_m$ is generated by a digital-to-analog converter (DAC) 211 in the gamma voltage generator 200 illustrated in FIG. 2. Besides, the gamma voltage $V_{m+1}$ is generated by dividing the gamma voltage $V_P$ which generated by a DAC 212 and the gamma voltage $V_m$ with a resistor string composed of resistors $R_1$~$R_n$. Accordingly, the relationship between gamma voltages $V_{m+1}$, $V_m$, and $V_P$ can be expressed as:

$$V_{m+1}=A_m(V_m-V_P)+V_P \quad (2)$$

In foregoing expression (2), $A_m$ is the divide ratio of the resistor string composed of the resistors $R_1$~$R_n$, and which can be expressed as:

$$A_m = \frac{R_2 + R_3 + \ldots + R_n}{R_1 + R_2 + R_3 + \ldots + R_n} \quad (3)$$

The following expression can be obtained by bringing foregoing expression (2) into foregoing expression (1):

$$V_{mk}=A_{mk}(V_p-V_m)+V_m \quad (4)$$

wherein $A_{mk}=(1-A_m)(m_k-m)$.

It can be understood from foregoing expression (4) that the gamma voltage Vmk corresponding to the pixel data grayscale mk can be obtained by multiplying the difference between the gamma voltage $V_m$ and the gamma voltage $V_p$ by a specific multiple $A_{mk}$ and then adding the gamma voltage $V_m$ to the obtained product.

Figure 4:
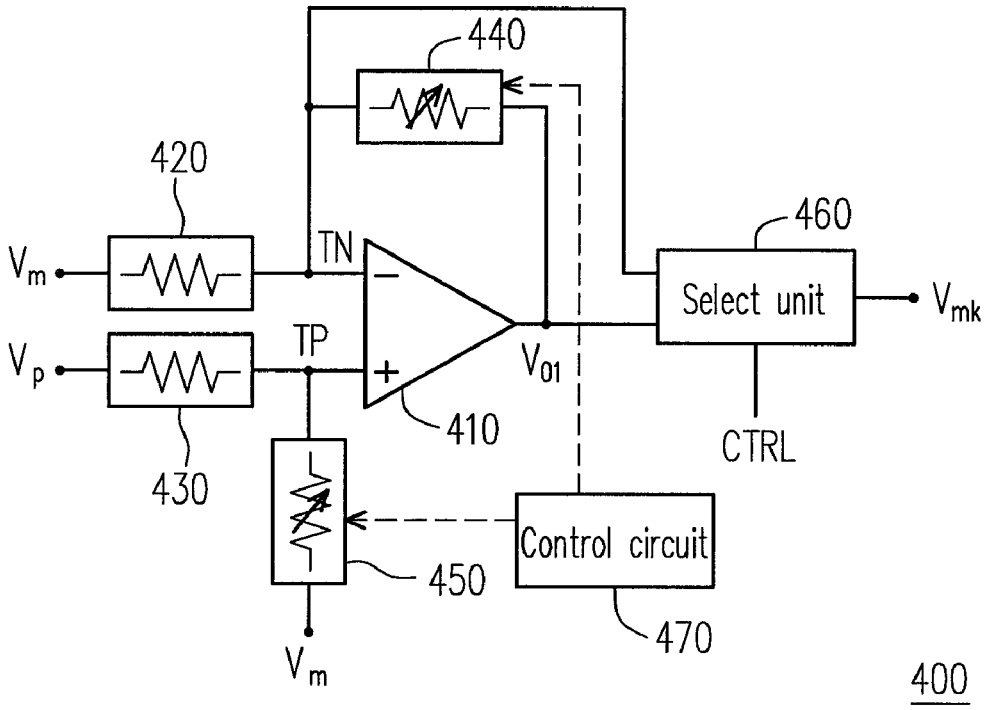
FIG. 4 is a diagram of a gamma voltage generator 400 according to an embodiment of the present invention.

FIG. 4 is a diagram of a gamma voltage generator 400 according to an embodiment of the present invention. Referring to FIG. 4, the gamma voltage generator 400 includes an operation amplifier 410, reference impedance units 420~430, variable impedance units 440~450, and a select unit 460. The operation amplifier 410 has a first input terminal TN, a second input terminal TP, and an amplified output terminal. One terminal of the reference impedance unit 420 receives a first gamma voltage $V_m$, and another terminal thereof is coupled to the first input terminal TN of the operation amplifier 410. One terminal of the reference impedance unit 430 receives a second gamma voltage $V_P$, and another terminal thereof is coupled to the second input terminal TP of the operation amplifier 410. The variable impedance unit 440 is coupled between the first input terminal TN and the amplified output terminal of the operation amplifier 410, and the variable impedance unit 450 is coupled between the second input terminal TP of the operation amplifier 410 and the terminal of the reference impedance unit for receiving the first gamma voltage $V_m$.

The potential difference between the first input terminal TN and the second input terminal TP of the operation amplifier 410 is close to zero, and in the present embodiment, it is assumed that the impedances provided by the reference impedance units 420 and 430 are both Ra and the variable impedances provided by the variable impedance units 440~450 are both Rb. Thus, the relationship between the first gamma voltage $V_m$, the second gamma voltage $V_P$, and the amplified output voltage $V_{o1}$ can be obtained through a voltage division formula as:

$$V_{ol} = \frac{Ra}{Rb}(V_P - V_m) + V_m \quad (5)$$

It should be mentioned that Ra/Rb in foregoing expression (5) is equal to $A_{mk}$ in foregoing expression (4).

In addition, foregoing assumption that the impedances provided by the reference impedance units 420 and 430 are both Ra and the variable impedances provided by the variable impedance units 440~450 are both Rb is only an example used herein for simplifying the expression (5) but not for limiting the scope of the present invention. Herein, the impedances provided by the reference impedance units 420 and 430 may also be different, and the variable impedances provided by the variable impedance units 440 and 450 may also be different.

The select unit 460 is coupled to the operation amplifier 410 and receives the first gamma voltage $V_m$ and the amplified output voltage $V_{o1}$. The select unit 460 determines whether to transmit the gamma voltage $V_m$ or the amplified output voltage $V_{o1}$ according to a control signal CTRL so as to generate an interpolated gamma output voltage $V_{mk}$. The select unit 460 is disposed because the amplified output voltage $V_{o1}$ generated by the operation amplifier 410 based on foregoing expression (5) cannot be equal to the gamma voltage $V_m$. Thus, when the gamma voltage generated corresponding to the pixel data grayscale is equal to the gamma voltage $V_m$, the gamma voltage $V_m$ can be selected according to the control signal CTRL and output as the interpolated gamma output voltage $V_{mk}$ by the select unit 460.

In order to allow those having ordinary knowledge in the art to better understand the present embodiment, an actual example of the present embodiment will be described below with reference to FIG. 4.

Referring to FIG. 4 again, assuming the input pixel data is grayscale 30, the output pixel data obtained through floating-point calculation is grayscale 34.437 (=30×1.1479). Besides, assuming the input pixel data is grayscale 31, the output pixel data obtained through floating-point calculation is grayscale 35.5849 (=31×1.1479). In order to output a voltage close to grayscale 34.437 or grayscale 35.5849, the first gamma voltage $V_m$ is made equal to the original voltage corresponding to the grayscale 30, the second gamma voltage $V_p$ is made equal to the original voltage corresponding to the grayscale 36, and the relationships between the reference impedance units 420 and 430 and the variable impedance units 440~450 are adjusted, so that the interpolated gamma output voltage $V_{mk}$ can be made equal to the voltage close to the grayscale 34.437 or 35.5849.

It should be mentioned that the relationships between the reference impedance units 420 and 430 and the variable impedance units 440 and 450 can be adjusted by using a control circuit 470 with calculation ability. The control circuit 470 adjusts the relationships between the reference impedance units 420 and 430 and the variable impedance units 440 and 450 by adjusting the variable impedances provided by the variable impedance units 440 and 450. The control circuit 470 may have following calculation rules.

A corresponding resistor selection is output according to the product of an input pixel data and a specific multiple (the multiplication can be carried out by a digital circuit). Namely, a database (or lookup table) is established based on different resistor selections corresponding to the products of different pixel data and different multiples, and a desired resistor selection is then obtained according to the product of an input pixel data and a specific multiple.

A corresponding resistor selection is output according to an input pixel data and a specific multiple (no multiplication is carried out). Namely, a table of different resistor selections corresponding to different pixel data and different multiples is established, and once a pixel data and a multiple are input, the desired resistor selection can be obtained by looking up the table according to the input pixel data and multiple.

A resistor selection is directly output according to a multiple. In other words, different resistor selection is selected according to different multiple regardless of what the pixel data is.

Different resistor selection is selected according to different image characteristic (for example, brightness, contrast, or other characteristics of an image, and the image characteristic can be obtained through existing hardware or software techniques such as statistics, probability, image processing, or mathematics). For example, different resistor selections are output corresponding to images having different brightness, contrast, color distribution, and spectrum distribution, etc.

The aforementioned multiple refers to the slope of a gamma conversion curve.

Thus, the visual effect of an image can be dynamically and precisely changed through such dynamic resistor switching and control mechanism. However, the technique provided by the present invention may also be turned off, namely, the original gamma voltage corresponding to each grayscale is changed.

Figure 5A:
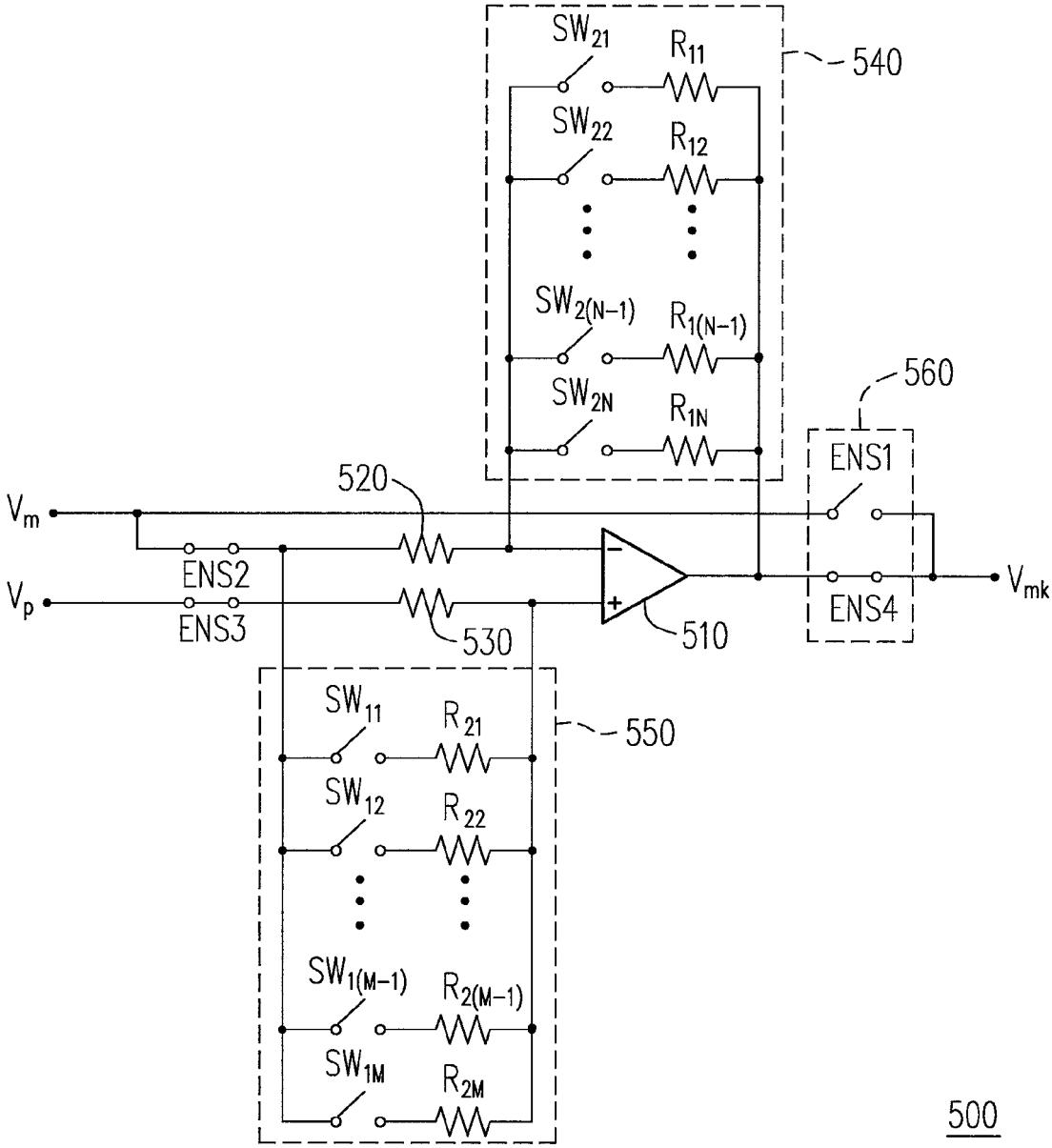
FIG. 5A is a diagram of a gamma voltage generator 500 according to an embodiment of the present invention.

FIG. 5A is a diagram of a gamma voltage generator 500 according to an embodiment of the present invention. Referring to FIG. 5A, similarly, the gamma voltage generator 500 includes an operation amplifier 510, reference impedance units 520~530, variable impedance units 540~550, and a select unit 560. Besides, the gamma voltage generator 500 further includes connect switches ENS2 and ENS3 which are respectively coupled on the paths for the reference impedance unit 520 to receive the first gamma voltage $V_m$ and the path for the reference impedance unit 530 to receive the second gamma voltage $V_P$. When the connect switches ENS2 and ENS3 are switched on, the two input terminals of the operation amplifier 510 respectively receive the first gamma voltage $V_m$ and the second gamma voltage $V_P$ through the reference impedance units 520 and 530. Contrarily, when the connect switches ENS2 and ENS3 are switched off, the two input terminals of the operation amplifier 510 are floated. The reference impedance units 520~530 are composed of resistors.

In the present embodiment, the variable impedance unit 540 includes N switches $SW_{21}$~$SW_{2N}$ and N impedance elements $R_{11}$~$R_{1N}$, wherein N is a positive integer. Each of the impedance elements (for example, $R_{11}$) and each of the switches (for example, $SW_{21}$) are connected in series between one and another terminal of the variable impedance unit 540. The variable impedance provided by the variable impedance unit 540 can be dynamically changed through different on/off states of the switches $SW_{21}$~$SW_{2N}$. It should be noted that in order to avoid an infinite impedance provided by the variable impedance unit 540 (open circuit), at least one of the switches $SW_{21}$~$SW_{2N}$ has to be turned on.

Similarly, the variable impedance unit 550 includes M switches SW11~SW1M and M impedance elements R21~R2M, wherein M is a positive integer. Each of the impedance elements (for example, R21) and each of the switches (for example, SW11) are connected in series between one and another terminal of the variable impedance unit 550. The variable impedance provided by the variable impedance unit 550 can be dynamically changed through different on/off states of the switches SW11~SW1M. It should be noted that in order to avoid an infinite impedance provided by the variable impedance unit 550 (open circuit), at least one of the switches SW11~SW1M has to be turned on.

In addition, the select unit 560 is composed of select switches ENS1 and ENS4. One terminal of the select switch ENS1 receives the first gamma voltage Vm, and the other terminal thereof is coupled to the connect switch ENS4. The terminal of the connect switch ENS4 which is not coupled to the select switch ENS1 is coupled to the amplified output terminal of the operation amplifier 510. Only one of the select switches ENS1 and ENS4 can be turned on, namely, the select switches ENS1 and ENS4 cannot be turned on together.

When the select switch ENS1 is turned on while the select switch ENS4 is turned off, the gamma voltage generator 500 directly outputs the first gamma voltage $V_m$, and accordingly the connect switches ENS2 and ENS3 are turned off.

Figure 5B:
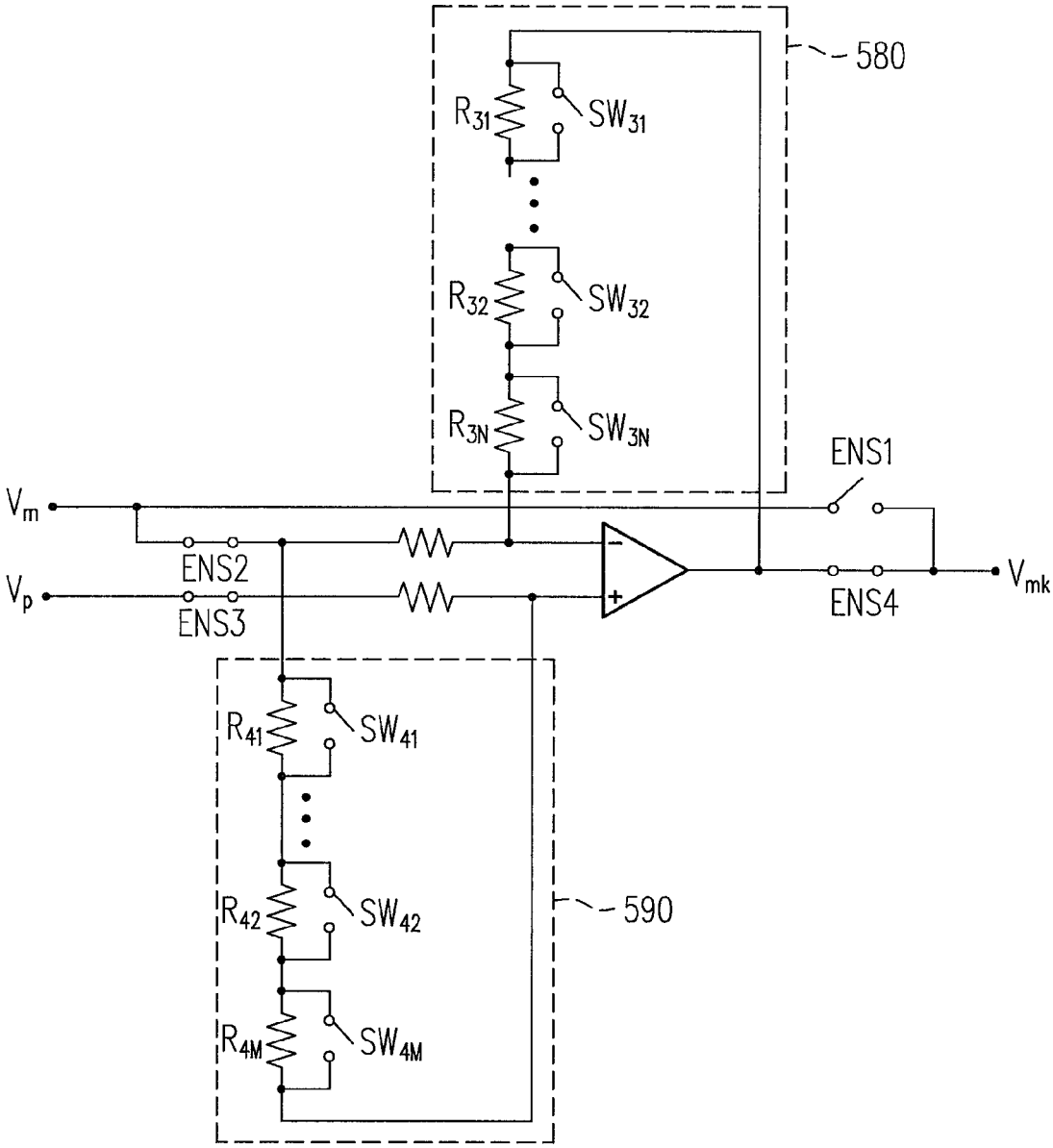
FIG. 5B is a diagram of a variable impedance unit in the gamma voltage generator 500 according to another embodiment of the present invention.

FIG. 5B is a diagram of a variable impedance unit in the gamma voltage generator 500 according to another embodiment of the present invention. Referring to FIG. 5B, the couplings between the resistors and switches in the variable impedance units 580 and 590 are different from those in the variable impedance units 540 and 550 illustrated in FIG. 5A. The variable impedance unit 580 includes N impedance elements $R_{31}$~$R_{3N}$ and N switches $SW_{31}$~$SW_{3N}$, wherein the switches are respectively connected to the impedance elements in parallel (for example, the switch $SW_{31}$ and the impedance element $R_{31}$ are connected in parallel), and these connected switches and impedance elements are further connected in series between one and another terminal of the variable impedance unit 580.

Similarly, the variable impedance unit 590 includes M impedance elements $R_{41}$~$R_{4M}$ and M switches $SW_{41}$~$SW_{4M}$, wherein the switches and the impedance elements are respectively connected in parallel (for example, the switch $SW_{41}$ and the impedance element $R_{41}$ are connected in parallel), and these connected switches and impedance elements are further connected in series between one and another terminal of the variable impedance unit 590.

However, in the variable impedance units 580 and 590, at least one of the switches is turned off in order to avoid short circuit.

It should be mentioned that in the present embodiment, all the resistors in the gamma voltage generator 500 are used for generating impedances. In other words, the gamma voltage generator 500 in the present embodiment can be implemented with any elements which can produce impedance. Namely, the resistors used in the present embodiment can be replaced with long channel transistors or switching capacitors.

Figure 6:
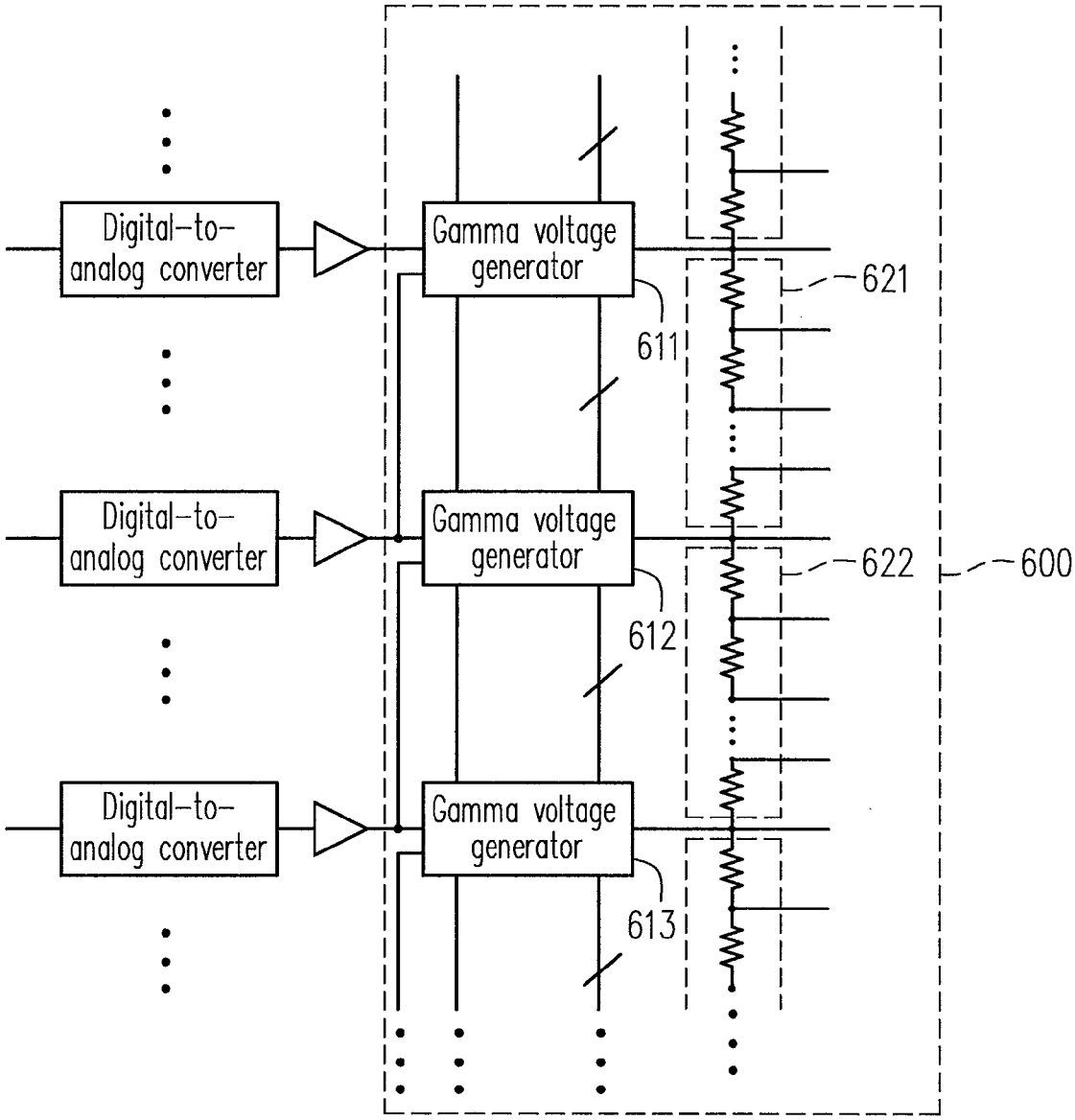
FIG. 6 is a diagram of a gamma voltage generating apparatus 600 according to an embodiment of the present invention.

FIG. 6 is a diagram of a gamma voltage generating apparatus 600 according to an embodiment of the present invention. Referring to FIG. 6, the gamma voltage generating apparatus 600 includes a plurality of gamma voltage generators 611~613 and a plurality of voltage dividing elements 621~622. The implementation of the gamma voltage generators 611~613 is the same as that of the gamma voltage generators 400 and 500 described in foregoing embodiments therefore will not be described herein.

The voltage dividing elements 621~622 respectively receive the interpolated gamma output voltages generated by the gamma voltage generators 611~613 and divide these voltages to generate a plurality of divided interpolated gamma output voltages as the gamma voltages corresponding to a plurality of pixel data grayscales.

As described above, in the present invention, an interpolated gamma output voltage corresponding to a floating-point pixel data grayscale can be generated by using an operation amplifier through an interpolation technique. Thereby, image distortion can be avoided and the display quality of a display panel can be improved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A gamma voltage generator, comprising:

an operation amplifier, having a first input terminal, a second input terminal, and an amplified output terminal, wherein the amplified output terminal generates an amplified output voltage;

a first reference impedance unit, having one terminal for receiving a first gamma voltage and another terminal coupled to the first input terminal of the operation amplifier;

a second reference impedance unit, having one terminal for receiving a second gamma voltage and another terminal coupled to the second input terminal of the operation amplifier;

a first variable impedance unit, coupled between the first input terminal and the amplified output terminal of the operation amplifier, for providing a first variable impedance;

a second variable impedance unit, coupled between the second input terminal of the operation amplifier and the terminal of the first reference impedance unit for receiving the first gamma voltage, for providing a second variable impedance; and a select unit, coupled to the operation amplifier, for selecting the amplified output voltage or the first gamma voltage according to a control signal to generate an interpolated gamma output voltage.

2. The gamma voltage generator according to claim 1, wherein the first variable impedance unit comprises:

N first impedance elements, wherein N is a positive integer; and

N first switches, wherein each of the first impedance elements and each of the first switches are connected in series between one and another terminal of the first variable impedance unit, and at least one of the first switches is turned on.

3. The gamma voltage generator according to claim 1, wherein the first variable impedance unit comprises:

N first impedance elements, connected in series between one and another terminal of the first variable impedance unit, wherein N is a positive integer; and N first switches, respectively connected to the first impedance elements in parallel, wherein at least one of the first switches is turned off.

4. The gamma voltage generator according to claim 1, wherein the second variable impedance unit comprises:

M second impedance elements, wherein M is a positive integer; and

M second switches, wherein each of the second impedance elements and each of the second switches are connected in series between one and another terminal of the second variable impedance unit, and at least one of the second switches is turned on.

5. The gamma voltage generator according to claim 1, wherein the second variable impedance unit comprises:

M second impedance elements, connected in series between one and another terminal of the second variable impedance unit, wherein M is a positive integer; and M second switches, respectively connected to the second impedance elements in parallel, wherein at least one of the second switches is turned off.

6. The gamma voltage generator according to claim 1, wherein the select unit comprises:

a first select switch, having one terminal for receiving the first gamma voltage; and a second select switch, having one terminal coupled to the amplified output terminal of the operation amplifier for receiving the amplified output voltage and another terminal coupled to another terminal of the first select switch;

wherein the first select switch and the second select switch generate the interpolated gamma output voltage according to the control signal, and the first select switch and the second select switch have different on and off states.

7. The gamma voltage generator according to claim 1, further comprising:

a first connect switch, coupled on a path for the first reference impedance unit to receive the first gamma voltage, for switching on or off the path for the first reference impedance unit to receive the first gamma voltage.

8. The gamma voltage generator according to claim 1, further comprising:

a second connect switch, coupled on a path for the second reference impedance unit to receive the second gamma voltage, for switching on or off the path for the second reference impedance unit to receive the second gamma voltage.

9. The gamma voltage generator according to claim 1, wherein the first reference impedance unit is a resistor.

10. The gamma voltage generator according to claim 1, wherein the second reference impedance unit is a resistor.

11. The gamma voltage generator according to claim 1, further comprising:

a control circuit, for adjusting the first variable impedance and the second variable impedance respectively provided by the first variable impedance unit and the second variable impedance unit.

12. A gamma voltage generating apparatus, comprising:

a plurality of gamma voltage generators, wherein each of the gamma voltage generators comprises:

an operation amplifier, having a first input terminal, a second input terminal, and an amplified output terminal, wherein the amplified output terminal generates an amplified output voltage;

a first reference impedance unit, having one terminal for receiving a first gamma voltage and another terminal coupled to the first input terminal of the operation amplifier, wherein the first gamma voltage is one of a plurality of gamma voltages;

a second reference impedance unit, having one terminal for receiving a second gamma voltage and another terminal coupled to the second input terminal of the operation amplifier, wherein the second gamma voltage is another one of the plurality of gamma voltages;

a first variable impedance unit, coupled between the first input terminal and the amplified output terminal of the operation amplifier, for providing a first variable impedance;

a second variable impedance unit, coupled between the second input terminal of the operation amplifier and one terminal of the first reference impedance unit for receiving the first gamma voltage for providing a second variable impedance; and a select unit, coupled to the operation amplifier, for selecting the amplified output voltage or the first gamma voltage according to a control signal to generate an interpolated gamma output voltage; and a plurality of voltage dividing elements, sequentially connected in series between terminals of the gamma voltage generators for generating the interpolated gamma output voltages, for generating a plurality of divided interpolated gamma output voltages.

13. The gamma voltage generating apparatus according to claim 12, wherein the first reference impedance unit comprises:

N first impedance elements, wherein N is a positive integer; and

N first switches, wherein each of the first impedance elements and each of the first switches are connected in series between one and another terminal of the first reference impedance unit, and at least one of the first switches is turned on.

14. The gamma voltage generating apparatus according to claim 12, wherein the first reference impedance unit comprises:

N first impedance elements, connected in series between one and another terminal of the first reference impedance unit, wherein N is a positive integer; and N first switches, respectively connected to the first impedance elements in parallel, wherein at least one of the first switches is turned off.

15. The gamma voltage generating apparatus according to claim 12, wherein the second reference impedance unit comprises:

M second impedance elements, wherein M is a positive integer; and

M second switches, wherein each of the second impedance elements and each of the second switches are connected in series between one and another terminal of the second reference impedance unit, and at least one of the second switches is turned on.

16. The gamma voltage generating apparatus according to claim 12, wherein the second reference impedance unit comprises:

M second impedance elements, connected in series between one and another terminal of the second reference impedance unit, wherein M is a positive integer; and M second switches, respectively connected to the second impedance elements in parallel, wherein at least one of the second switches is turned off.

17. The gamma voltage generating apparatus according to claim 12, wherein the select unit comprises:

a first select switch, having one terminal for receiving the first gamma voltage; and a second select switch, having one terminal coupled to the amplified output terminal of the operation amplifier for receiving the amplified output voltage and another terminal coupled to another terminal of the first select switch;

wherein the first select switch and the second select switch generate the interpolated gamma output voltage according to the control signal, and the first select switch and the second select switch have different on and off states.

18. The gamma voltage generating apparatus according to claim 12, further comprising:

a first connect switch, coupled on a path for the first reference impedance unit to receive the first gamma voltage, for switching on or off the path for the first reference impedance unit to receive the first gamma voltage.

19. The gamma voltage generating apparatus according to claim 12 further comprising:

a second connect switch, coupled on a path for the second reference impedance unit to receive the second gamma voltage, for switching on or off the path for the second reference impedance unit to receive the second gamma voltage.

20. The gamma voltage generating apparatus according to claim 12, wherein the first reference impedance unit is a resistor.

21. The gamma voltage generating apparatus according to claim 12, wherein the second reference impedance unit is a resistor.

22. The gamma voltage generating apparatus according to claim 12, wherein the voltage dividing elements comprise a plurality of resistors connected in series.

23. The gamma voltage generating apparatus according to claim 12, further comprising a plurality of output buffers, wherein the plurality of output buffers are coupled to the voltage dividing elements for receiving the divided interpolated gamma output voltages.

24. The gamma voltage generating apparatus according to claim 12, further comprising:

a control circuit, for adjusting the first variable impedances and the second variable impedances respectively provided by the first variable impedance units and the second variable impedance units.

* * * * *